US005088874A

United States Patent [19]

Quittner

[11] Patent Number: 5,088,874

[45] Date of Patent: Feb. 18, 1992

[54] HIGHWAY BARRIER TRANSPORTER

[75] Inventor: John P. Quittner, Castle Cove, Australia

[73] Assignee: Energy Absorption Systems, Inc., Chicago, Ill.

[21] Appl. No.: 520,671

[22] Filed: May 8, 1990

[51] Int. Cl.[5] ..... E01F 13/00

[52] U.S. Cl. ..... 414/460; 414/459; 414/786; 414/10; 256/13.1; 404/6; 404/12; 404/73

[58] Field of Search ..... 414/458, 459, 460, 461, 414/540, 539, 10, 339, 786; 404/6, 9, 12, 13, 14, 72, 73; 256/13.1

[56] References Cited

U.S. PATENT DOCUMENTS

| | | | |
|---|---|---|---|
| 810,980 | 1/1906 | Riddle . | |
| 2,959,310 | 5/1957 | Meister . | |
| 3,958,890 | 5/1976 | Ferrari . | |
| 4,017,200 | 4/1977 | Woods . | |
| 4,500,225 | 2/1985 | Quittner . | |
| 4,566,389 | 1/1986 | Theurer et al. | 414/459 X |
| 4,624,601 | 11/1986 | Quittner . | |
| 4,653,954 | 3/1987 | Booth . | |
| 4,666,332 | 5/1987 | Burgett . | |
| 4,761,108 | 8/1988 | Kress . | |

OTHER PUBLICATIONS

Coral Sales Company, Clackamas Oregon, Information Sales Sheet for Quickchange Moveable Barrier.

Techniques Speciales de Securite, France, Information Sales Sheet for The Improvement of Gennevilliers Viaduct.

*Primary Examiner*—Frank E. Werner

*Attorney, Agent, or Firm*—Willian Brinks Olds Hofer Gilson & Lione

[57] ABSTRACT

A transporter for a length of highway barriers includes a series of barrier transporting units, each having at least one pair of wheels positioned to straddle a length of highway barriers, at least one engaging device configured to engage one of the barriers, and at least one lifting device coupled to the engaging device to lift the engaging device and the engaged barriers. Articulating couplings interconnect axially adjacent transporting units to form a train configured to straddle the length of highway barriers such as the train can be moved over a length of highway barriers to be transported. Two tractors are connected to the train, one at each end of the train in line with the train to move the train. This transporter can be used by driving it over a length of highway barriers, using the engaging and lifting devices to lift the barriers, and then driving the transporter and the engaged barriers to a new location. The barriers are then lowered and released and the transporter is driven away, leaving the highway barriers at the new location.

39 Claims, 3 Drawing Sheets

HIGHWAY BARRIER TRANSPORTER

BACKGROUND OF THE INVENTION

This invention relates to highway barriers, and in particular to a transporter for moving a length of interconnected highway barriers along a roadway.

Highway barriers are commonly used to form temporary walls between two lines of traffic or between a line of traffic and a construction zone.

One commonly used highway barrier is formed of concrete and is provided with lugs at each end that allow adjacent barriers to be linked together. When used to protect a construction site, it is often necessary to move such barriers along the length of a roadway as a construction crew advances from one highway section to the next.

One effective highway barrier is described in Quittner U.S. Pat. No. 4,500,225. This barrier has a T-shaped upper end which is used to lift the barrier, as for example in shifting the barrier from one lane to a next adjacent lane. Note in particular the barrier transfer device shown in Quittner '225, which includes an S-shaped conveyor that operates to lift T-shaped barriers, move them laterally to a next adjacent lane, and then deposit the barriers in a new position. This approach has been found to be an extremely efficient method for transferring barriers to allow lane reversal.

However, the problems encountered in transporting barriers longitudinally along a roadway are somewhat different than those encountered in shifting barriers laterally across a roadway. One prior art approach to transporting barriers longitudinally along a roadway is to load the barriers onto a truck and to simply drive the truck along the roadway to the new location. This approach provides the disadvantage that the truck occupies a lane of traffic during loading and transporting operations, and thus interferes with normal traffic flow. Furthermore, the time and manpower required to move the barriers onto and off of the truck may be excessive in many applications.

A second approach of the prior art is to use a transfer device such that shown in Quittner '225 to transport a length of barriers to the new location. This approach reduces the manpower required to load and unload barriers as compared with the use of trucks described above. Booth U.S. Pat. No. 4,653,954 also describes an apparatus for moving a traffic barrier, in which a length of barriers is supported inside a moving apparatus. The transfer devices of Quittner '225 and Booth have been designed primarily to transfer barriers laterally, and have not been optimized to transport barriers longitudinally to a new location.

Another approach to the transportation of barriers along a roadway is disclosed in Burgett U.S. Pat. No. 4,666,332. The Burgett approach is to include wheeled lifting units between adjacent barriers as an integral part of the length of barriers. These wheeled lifting units can be used to raise the barriers for towing. This approach substantially complicates the barriers, because the wheeled lifting units are integrated into the line of barriers.

It is an object of this invention to provide an improved apparatus and method for efficiently transporting barriers longitudinally along a roadway, without substantially obstructing a traffic lane.

It is a further object to this invention to avoid increasing the cost of the barriers, and in particular to avoid the need for wheeled or lifting units to be incorporated into the barrier themselves.

SUMMARY OF THE INVENTION

According to this invention, a transporter is provided for a length of highway barriers. This transporter comprises a plurality of barrier transporting units, each comprising at least one pair of wheels positioned to straddle the barriers, at least one engaging device configured to engage the barriers, and at least one lifting device coupled to the engaging device to lift the engaging device and the engaged barriers. A plurality of articulating couplings interconnect axially adjacent transporting units to form a train configured to straddle the length of highway barriers such that the train can be moved over a length of highway barriers to be transported. One or more tractors are each positioned at a respective end of the train in line with the train to move the train.

Preferably, two tractors are provided, one at each end of the train, in order to eliminate the need for the train to be turned around as it moves back and forth while transporting barriers between an original and a new position.

This invention is also directed to a method for using the transporting apparatus described above comprising the steps of driving the set of tractors to move the train over the length of highway barriers in straddling relation therewith, engaging the engaging devices with at least selected ones of the highway barriers, operating the lifting devices to lift the engaging devices and the engaged barriers, driving the set of tractors to transport the train and the engaged highway barriers to a new location, operating the lifting devices to lower the engaging devices and the engaged barriers, releasing the engaging devices from the barriers, and driving the set of tractors to move the train, thereby leaving the highway barriers at the new location.

The preferred embodiments achieve the objects set out above. Lengths of interconnected barriers are lifted and lowered without disconnecting them from one another, and relatively long lengths of interconnected barriers can be transported by a small crew. This can often be done without obstructing a lane of traffic, because the transporter train and the tractors are sufficiently narrow in width to be able to travel on the breakdown lane of a conventional limited access highway. Additionally, the cost of the barriers is not increased in any way.

The invention itself, together with further objects and attendant advantages, will best be understood by reference to the following detailed description, taken in conjunction with the accompanying drawings.

DETAILED DESCRIPTION OF THE PRESENTLY PREFERRED EMBODIMENTS

Figure 1:
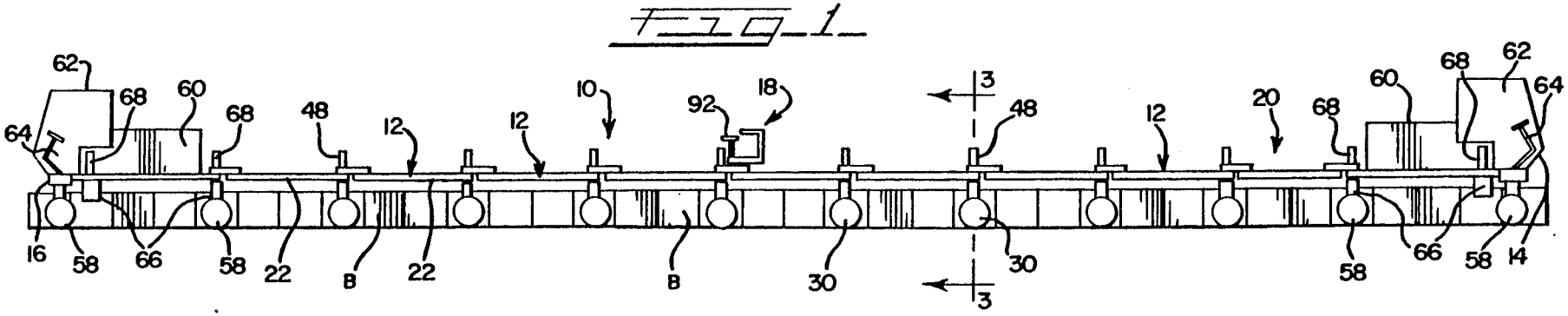
FIG. 1 is an elevational view of a highway barrier transporter that incorporates a presently preferred embodiment of this invention.

FIG. 1 is an elevation of a highway barrier transporter 10 which embodies the present invention. The transporter 10 includes a line of interconnected transporting units or trailers 12, and a pair of tractors 14, 16, one arranged at each end of the line of trailers 12. The trailers 12 are joined end to end to form a train, and the train additionally includes an intermediate steering station 18 and an adaptor 20.

Figure 2:
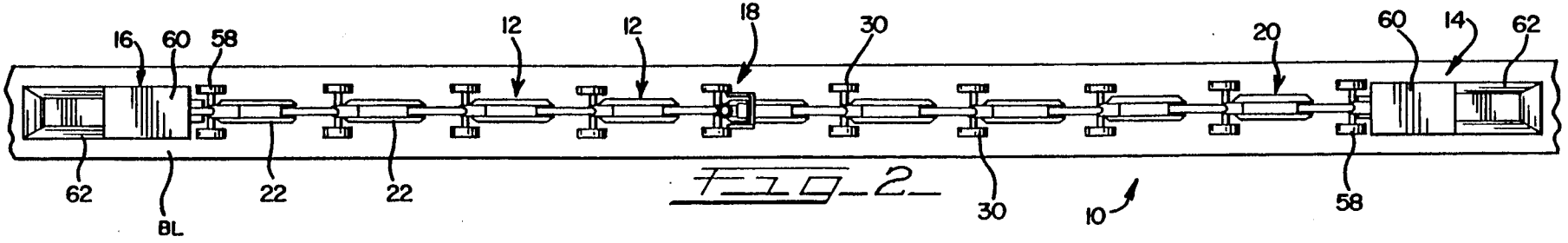
FIG. 2 is a plan view of the transporter of FIG. 1.
Figure 3:
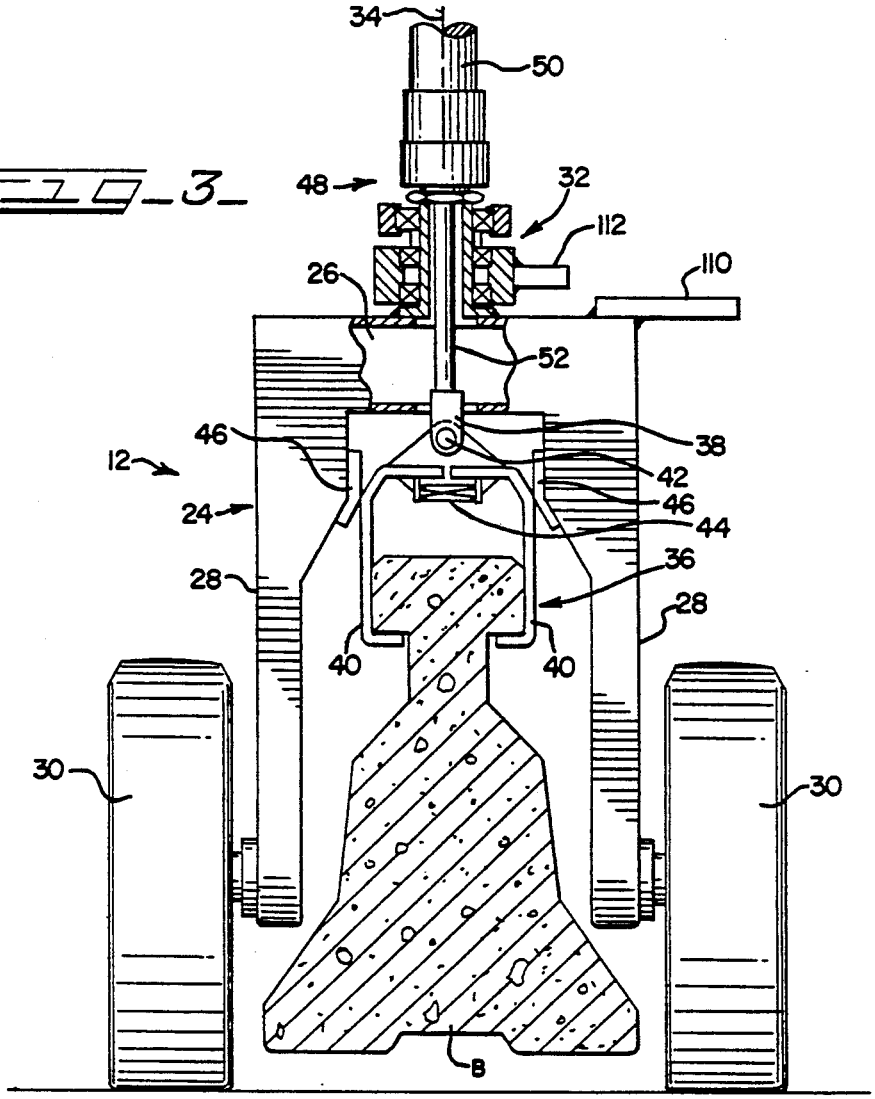
FIG. 3 is a cross-sectional view taken along line 3—3 of FIG. 1.

FIG. 2 shows a plan view of the transporter 10, and FIG. 3 shows a cross-sectional view of one of the trailers 12.

As shown in FIGS. 1, 2 and 3, each of the trailers 12 includes a central, longitudinally extending spine 22. One end of the spine 22 supports a U-shaped frame 24 having a central section 26 and a pair of spaced side sections 28. Each central section 26 is pivotably secured to the end of the respective spine 22. Each of the side sections 28 supports at its lower end a wheel 30. Thus, each of the trailers 12 includes a pair of wheels 30 which are arranged to straddle a highway barrier B as shown in FIG. 3.

Adjacent ones of the trailers 12 are interconnected by articulating couplings 32 which allow hinging movement around an axis 34 shown in FIG. 3.

Each of the frames 24 supports an engaging device 36 configured to engage one of the barriers B for lifting. Depending upon the configuration of the barrier B, the engaging device 36 can vary extensively in configuration. However, in this embodiment the engaging device 36 includes a support member 38 to which a pair of jaws 40 are pivotably mounted about an axis 42. A spring 44 is positioned between the jaws 40 to bias them outwardly, away from one another. The frame 24 defines jaw closing surfaces 46 which bear against upper portions of the jaws 40 to automatically close the jaws 40 when the jaws 40 are lifted, and to allow the spring 44 to open the jaws 40 when they are lowered.

As shown in FIG. 3 the barrier B includes a T-shaped upper portion, and the jaws 40 are configured to engage this T-shaped upper portion so as to suspend the barrier B as shown in FIG. 3. Alternately, jaws, pins, or other engaging devices may be configured to engage an alternate barrier (not shown) by fitting into sockets provided in the sides or top of the barrier or by fitting into relieved areas adjacent the base of the barrier. For example, the engaging devices can be adapted for use with the T-shaped slot in the top of the barrier shown in Quittner U.S. Pat. No. 4,624,601.

Returning to FIG. 3, each of the frames 24 also supports a lifting device 48. In this embodiment, the lifting device 48 comprises a hydraulic cylinder 50 having an extendable rod 52 which is mounted to the support member 38. By controlling pressure in the hydraulic cylinder 50 as described below in conjunction with FIG. 7, the rod 52 can either be (1) raised to the position shown in FIG. 3, in which the jaws 40 are automatically closed by the jaw closing surfaces 46 to lift the barrier B off the ground; or (2) lowered to place the barrier B on the ground and release the jaws 40. In alternate embodiments the lifting device 48 may include other types of actuators such as electric motors or other types of cylinders to achieve the desired lifting action.

Figure 6:
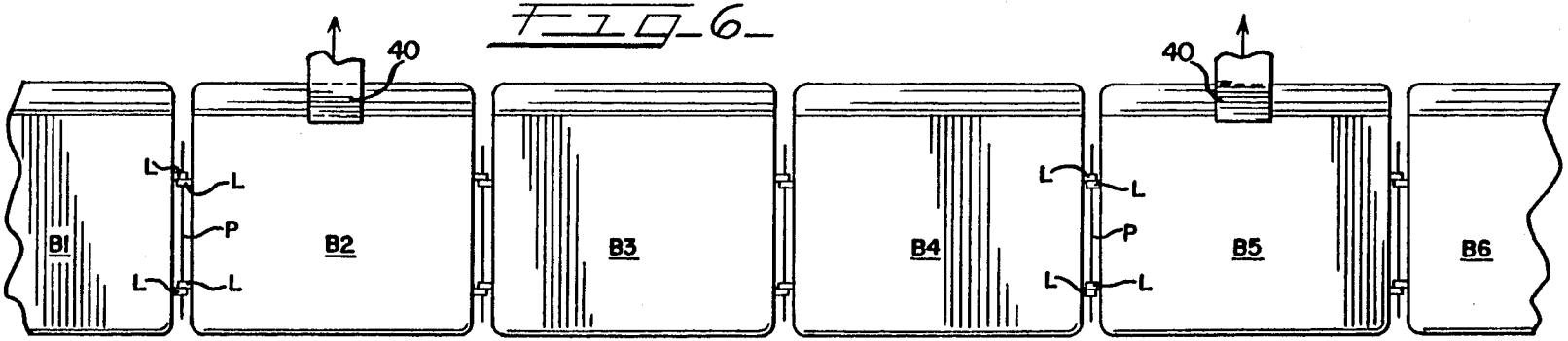
FIG. 6 is an elevation of a line of interconnected highway barrier modules suitable for use with the transporter of FIG. 1.

As shown in FIG. 1, each of the trailers 12 has a length substantially equal to that of three barriers B, and one engaging device 36 is provided for every three of the barriers B. This system has been designed for use with barriers such as those shown in FIG. 6, which include lugs L which are interconnected by a pin P between adjacent barriers. This interconnection between adjacent barriers B allows adjacent barriers to articulate with respect to one another and allows lifting forces on one barrier B to be transferred to adjacent barriers. For example, in FIG. 6 two adjacent sets of jaws 40 are shown. The jaws 40 on the left hand side of FIG. 6 directly lift the barrier B2, which in turn supports the barriers B1 and B3 via the lugs L and pins P. Similarly, the jaws 40 on the right hand side of FIG. 6 directly lift and support the barrier B5, which in turn lifts and supports the barriers B4 and B6 via the lugs L and the pins P. With this arrangement, the total number of engaging devices 36 and lifting devices 46 is approximately equal to one third of the total number of barriers B in the length being transported.

In general each trailer 12 can have a length substantially equal to N barriers, where N is a positive integer less than 6, and the engaging and lifting devices 36, 46 can be correspondingly spaced. In the presently preferred embodiment, N equals 3.

Each end of the train of transporting units 12 is connected to a respective tractor 14, 16. Each tractor 14, 16 is arranged to straddle the barriers B and include two pairs of wheels 58, as shows in FIGS. 1 and 2. Each tractor includes a source of power such as a diesel engine 60 which powers the wheels 58 of the tractors 14, 16 for traction and provides pressurized hydraulic fluid to operate the lifting devices 48. Additionally, the engine 60 provides power for steering the tractor and braking the tractors and the trailers 12. Each of the tractors includes a cab 62 for a driver who steers the tractor via a conventional steering gear 64. Each of the tractors includes a pair of engaging devices 66, which may be identical to the engaging devices 36 described above, and a pair of lifting devices 68, which may be identical to the lifting devices 48 described above. The devices 66, 68 barriers B disposed beneath the tractor.

The tractors 14, 16 provide important advantages in that they are narrow in width and are configured to straddle the barriers. However, in applications where these advantages can be sacrificed, it is possible to use a conventional truck as a tractor means for towing the transporter.

The transporter 10 includes a number of features to make operation more efficient. The transporter 10 has an overall length greater than a 100 feet, which allows it to transport a length of over 100 feet of interconnected barriers B at a time. At the same time, the maximum width of the transporting units 12, the adaptor 20 and tractors is 44 inches. In an case, the width should be less than four feet in order to allow the transporter 10 to travel along a break-down lane BL, as shown in FIG. 2, without obstructing traffic on an adjacent roadway. Not all embodiments will have an overall length greater than 100 feet, and in some applications the overall length of the transporter 10 may be 50 feet or less.

Another important feature of the transporter 10 is the intermediate steering station 18 positioned midway along the length of the train. The steering station 18 is controlled by an operator by means of steering gear 92 to improve tracking of the train along a curved path.

Figure 7:
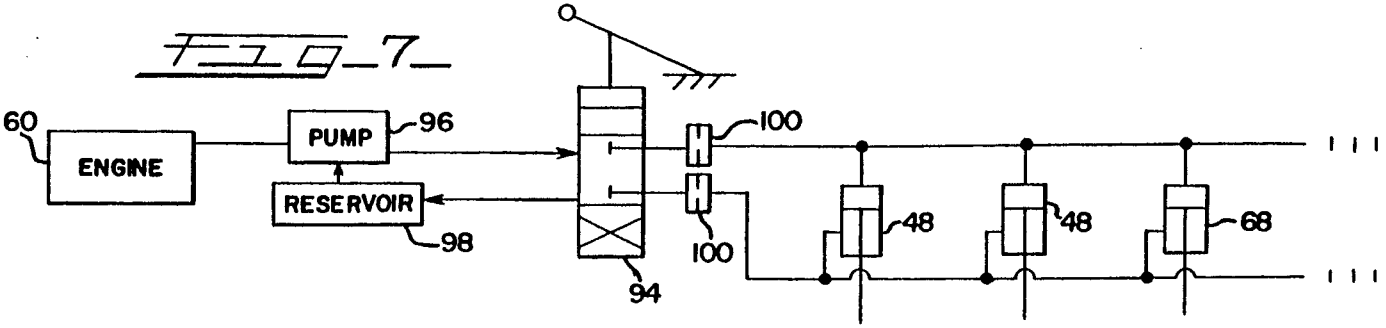
FIG. 7 is a schematic view of a hydraulic circuit of the transporter of FIG. 1.

A third feature relates to the structure shown in FIG. 7, which shows two of the lifting devices 48. As shown in FIG. 7 all the lifting devices 48 (as well as the lifting devices 68) are centrally controlled by a single three position valve 94 which is manually controlled by an operator in one of the tractors. In the position shown in FIG. 7 the valve 94 hydraulically locks each of the lifting devices 48, 68 in position. When the valve 94 is moved to a lower position, the valve 94 interconnects a pump 96 and a reservoir 98 to the lifting devices 48 so as to extend the lifting devices 48, thereby lowering any engaged barriers B. The pump is powered by the engine 60 of one of the tractors. Orifices 100 limit the maximum rate of movement of the lifting devices 48, 68. Conversely, when the valve 94 is raised from the position shown in FIG. 7, the valve 94 interconnects the lifting devices 48 and 68 with the pump 96 and the reservoir 98 so as to lift the attached engaging devices 36, 66 and any engaged barriers. Preferably, quick disconnect couplers (not shown) are used to interconnect hydraulic lines on the individual trailers 12 to form the hydraulic circuit of FIG. 7.

Figure 4:
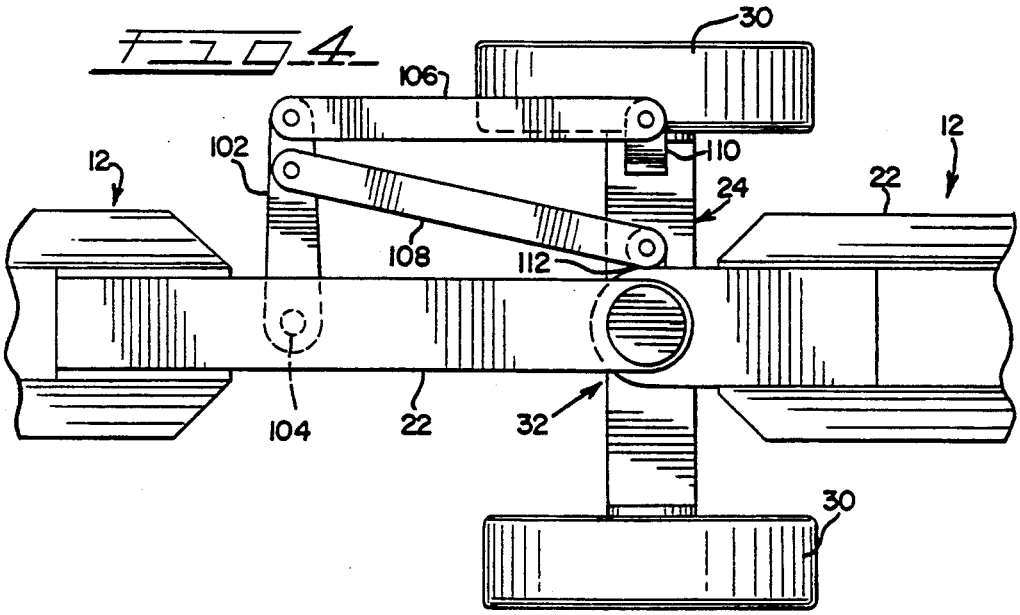
FIG. 4 is an enlarged plan view showing a steering gear linkage of the transporter of FIG. 2.

Another important feature of the transporter 10 relates to the manner in which the wheels 30 of individual trailers 12 are automatically steered so as to maintain tracking of the train along a curved or straight path. The preferred linkage is schematically shown in FIG. 4, where two adjacent spines 22 are shown to be pivotably connected by an articulated coupling 32. Additionally, the wheel supporting frame 24 is also pivotable about the axis defined by the coupling 32.

The automatic steering arrangement of FIG. 4 includes a control arm 102 which is pivotably mounted to one of the spines 22 so as to pivot about an axis 104. This control arm 102 is interconnected to the frame 24 by a first link 106 and to the forward end of the next adjacent spine 22 by a second link 108. Suitable attachment points are provided by lugs 110, 112 on the frame 24 and the spine 22, respectively.

The automatic steering arrangement of FIG. 4 operates as follows. When the left hand spine 22 as shown in FIG. 4 pivots in a counterclockwise direction about the coupling 32, the control arm 102 is pivoted in a clockwise direction by the link 108. This movement of the control arm 102 is transmitted by the link 106 to the frame 24 so as to pivot the frame 24 in a clockwise direction, thereby orienting the wheels 30 so as to improve the tracking of the train along the original path of the tractor. When the left hand spine 22 pivots in a clockwise direction, the linkage 102, 106, 108 pivots the frame 24 clockwise. The intermediate steering station 18 allows an operator to correct tracking errors not compensated for by the steering arrangement of FIG. 4.

Figure 5:
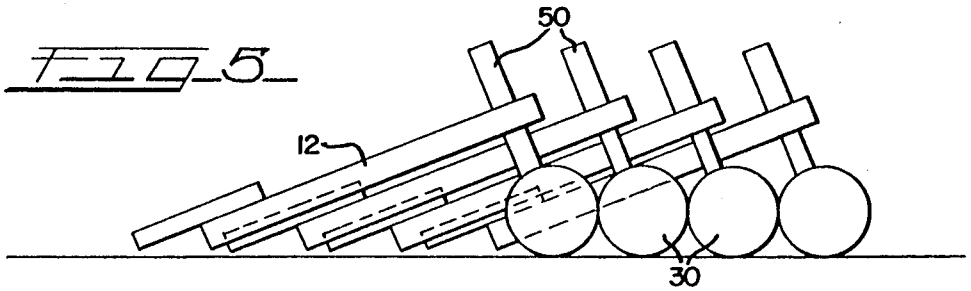
FIG. 5 is a schematic elevation showing the manner in which the trailers of FIG. 1 can be stacked for transport or storage.

FIG. 5 illustrates another feature of the trailers 12. As shown in FIG. 5 the spines 22 are shaped to fit between the frames 24 beneath the central sections 26. This allows the trailers 12 to be stacked compactly for storage and transport, with the wheels 30 of adjacent trailers 12 in contact.

It should be apparent that a wide range of conventional approaches can be used to implement the functions described above. The following paragraphs provide further information regarding preferred characteristics of the transporter 10 to clearly define the best mode presently contemplated by the inventor.

Steering System—The articulating couplings 32 between adjacent trailers 12 and between trailers 12 and tractors preferably provide pitch articulation of ±5 degrees, roll articulation of ±5 degrees, and steering articulation of ±30 degrees. Each of the tractors has a leading axle which is steerable by ±30 degrees to provide an 11 meter diameter turning circle. The axles of the tractor are provided without roll articulation.

Masses—The design masses for this embodiment are as follows:

Tractors: 4,000 kg per axle laden; 1,900 kg inboard axle unladen; 2,950 kg foremost and rearmost axles unladen.

Trailers: 2,640 kg per axle laden; 540 kg per axle unladen.

These masses have been selected to ensure traction over a range of surfaces, including wet and muddy asphalt. The laden mass of each tractor should be evenly distributed over the two axles to maximize traction.

Tires—The tires should be chosen as narrow as possible to carry the load. Presently preferred tires are as follows:

Tractor: 7.00×20 10 p. r. (e.g. Olympic Trojan HW or Michellin 700R20)

Trailer: 7.00×16 8 p. r. (available e.g. from Toyo, Olympic, Michellin 700 R16)

Wheels—The wheels for the tractors are preferably 20 inches in diameter by 6 inches in width, adapted to accept the driving units described below. The wheels for the trailers can be industry standard Bedford 16 inch by 6 inch truck wheels with 1.26 inch offset.

Braking—Each wheel of each of the tractors should be provided with parking and dynamic braking capabilities of 2000 Nm and 3000 Nm, respectively. Preferably, at least three of the trailers should have braked wheels.

Brake actuation—Preferably, the wheels of the trailers 12 and the tractors are braked using air actuation. This provides automatic parking and emergency features. Alternatively, electric braking systems may be used.

Traction—Preferably, the rear tractor is controlled to provide no more than 25% of the tractive effort, and each driven wheel of each tractor is driven with a start up torque of at least 3500 Nm with a maximum speed of 180 RPM. A suitable wheel unit can be obtained from Integrated Hydraulics as their Model SA1 M3 800. Lucas Fluid Power and Rexroth provide alternatives.

Stability—The main requirement for stability is that the train be operated in tension and not compression. In order to meet this requirement, the sequence of applying the brakes is important. The rear tractor brakes should be applied first, then the brakes of the transporting units, and finally the brakes on the leading tractor.

Power Requirements—The engine choice depends on transmission losses, on the distribution of ancillary drive power between the tractors, and on economics. Preferably, each of the tractors should be provided with a diesel engine having a power of a least 94 horse power.

Controls—Power distribution and braking should be applied sequentially and in the correct front to rear order in order to maintain stability of the train. The ideal control situation operates as follows:

parking brakes are controlled independently;

an accelerator lever is spring loaded to no load and when moved forward beings in the leading tractor until full power is developed and subsequently brings in the trailing tractor; on returning the lever the rear tractor power is reduced first; the accelerator lever can be moved rearwards to being in rear tractor braking only;

additional braking levers are provided to control the trailer and forward tractor braking, respectively.

In this way, normal driving and check braking is done by one lever and the driver is responsible for applying trailer brakes and front tractor brakes, in that sequence, only if rear tractor braking is inadequate. Braking should be released in the reverse sequence. Such a control system is well within the level of skill in the art. However, it must be emphasized that no central control system is required, and if desired a simple intercom between drivers in the two tractors can be used to coordinate braking and traction requirements as described above.

Tractor Services—Each of the tractors should be provided with the following services:

Hydraulic traction;

Hydraulic lifting for the barriers;

Hydraulic release of tractor parking brakes;

Pneumatic power for release and application of trailer brakes;

Electrical power for starting, lighting, control signalling, etc.

Trailer Connections and Services—the following services preferably run the length of the train.

Electrical controls—starting, shut down power and braking;

Hydraulic lifting for the barriers;

Pneumatic lines for trailer brakes.

Operation

The transporter 10 can be used to transport an interconnected length of barriers B quickly and efficiently. As a first step, the transporter 10 is driven over a length of highway barriers to be moved such that the tractors and the trailers 12 straddle the barriers B. The engaging devices 36, 66 are then engaged with selected ones and the barriers B as the lifting devices 48, 68 are operated to lift the engaging devices 36, 66 and the engaged barriers B. It should be noted that since the tractors straddle the barriers B, the transporter 10 can simply be driven into position without any preliminary adjustment or moving of the barriers B.

Once the barriers B have been lifted, the tractors can be driven to transport the train of trailers 12 and the engaged highway barriers B to a new location. Because a tractor is provided at each end of the train, there is no need to turn the train around. As shown in FIG. 1, the barriers B are preferably cantilevered beyond the front of the leading tractor which will approach the new location (to the right in FIG. 1). Once the transporter 10 and engaged barriers B have been driven to the new location, the lifting devices 48, 68 are operated to lower the engaged barriers B and to release them from the engaging devices 36, 66. The transporter 10 can then be driven away from the highway barriers B, which are left at the new location. Proper alignment of the barriers B in the new location is simplified by the fact that the forwardmost barrier B is cantilevered out beyond the forwardmost end of the leading tractor.

Because the transporter 10 is less than four feet in width, the transporter 10 and the engaged barriers B can be maintained entirely within a conventional breakdown lane as the transporter 10 is driven from the original to the new position. This significantly reduces interference with traffic on the adjacent roadway. Furthermore, since each end of the transporter 10 is provided with a tractor, the transporter 10 can shuttle back and forth between the original and the new positions without turning around, and without obstructing traffic.

From the foregoing, it should be apparent that an improved barrier transporter has been described which allows barriers to be moved longitudinally along a roadway without disconnecting barriers within the transported length, and often without obstructing traffic flow during barrier transport.

Of course, it should be understood that a wide range of changes and modifications can be made to the preferred embodiment described above. It is therefore intended that the foregoing detailed description be regarded as illustrative rather than limiting, and that it be understood that it is the following claims, including all equivalents, which are intended to define the scope of this invention.

I claim:

1. A transporter for a length of highway barriers of the type having a lifting surface, said transporter comprising:

a plurality of barrier transporting units, each comprising a longitudinal element, at least one pair of wheels coupled to the longitudinal element and positioned to straddle a length of highway barriers, at least one engaging device configured to engage one of the barriers at the respective lifting surface, and at least one lifting device coupled to the longitudinal element and the engaging device to lift the engaging device and engaged barriers;

a plurality of articulating couplings, each mounted to a respective end of a respective longitudinal element and interconnecting axially adjacent transporting units to form a train configured to straddle the length of highway barriers such that the train can be moved over a length of highway barriers to be transported;

a set of at least one automotive tractor, each positioned at and coupled to a respective end of the train in line with the train to move the train; and means for powering the lifting devices and the engaging devices.

2. The invention of claim 1 wherein each of the at least one tractor is configured to straddle the barriers such that each tractor can move along and over the length of barriers.

3. The invention of claim 2, wherein the maximum width of the transporter is less than 4 feet.

4. The invention of claim 1 wherein the highway barriers are interconnected by load bearing pivot joints, and wherein at least some of the lifting devices are positioned at a spacing between adjacent lifting devices of one lifting device every N barriers, where N is an integer greater than 1.

5. The invention of claim 4 wherein N is less than 6.

6. The invention of claim 5 wherein each of the transporting units has a length approximately equal to that of N barriers.

7. The invention of claim 4 wherein N equals 3.

8. The invention of claim 5 wherein each of the transporting units has a length approximately equal to that of three barriers.

9. The invention of claim 1 wherein each of the barriers defines a T-shaped upper portion, and wherein the engaging devices comprise opposed jaws operative to releasably engage the T-shaped upper ends and to suspend the barriers therefrom.

10. The invention of claim 1 wherein the train is no less than 50 feet in length.

11. The invention of claim 1 wherein the train is no less than 100 feet in length.

12. The invention of claim 1 further comprising means, included in the train and independent of the at least one tractor, for steering an intermediate section of the train positioned centrally of the ends of the train.

13. The invention of claim 1 wherein at least some of the transporting units each comprise:

a U-shaped wheel supporting frame having a central portion pivotably connected to one end of the respective longitudinal element and a pair of downwardly directed side portions spaced to receive one of the barriers therebetween;

wherein the wheels are each rotatably mounted at a lower end of a respective one of the side portions.

14. The invention of claim 13 wherein at least some of the engaging devices are mounted beneath respective ones of the central portions.

15. The invention of claim 14 wherein at least some of the lifting devices are mounted to respective ones of the central portions.

16. The invention of claim 13 wherein the longitudinal element of one transporting unit is configured to fit between the side portions of the frame of another transporting unit to allow the transporting units to be nested for compact storage.

17. A transporter for a length of highway barriers, of the type having a lifting surface comprising:

a plurality of barrier transporting units, each comprising:

a spine;

at least one pair of wheels coupled to the spine and positioned each on a respective side of the spine to straddle the barriers;

means, coupled to the spine, for engaging at least one of the barriers at the respective lifting surface; and means, coupled to the spine, for lifting the engaging means and engaged barriers;

means for pivotably coupling the spines of adjacent transporting units together to form a train configured to straddle the length of highway barriers such that the train can be moved over a length of highway barriers to be transported; and automotive tractor means positioned at and coupled to at least one end of the train in line with the train to move the train;

18. The invention of claim 17 wherein the tractor means comprises two tractors, each positioned at a respective end of the train.

19. The invention of claim 18 wherein each of the tractors is configured to straddle the barriers.

20. The invention of claim 19 wherein both the tractors and the train are no greater than four feet in width.

21. The invention of claim 20 wherein the train is no less than 50 feet in length.

22. The invention of claim 20 wherein the train is no less than 100 feet in length.

23. The invention of claim 17 wherein each of the barriers defines a T-shaped upper portion, and wherein the engaging means comprise opposed jaws for suspending the barriers from the T-shaped upper portion.

24. The invention of claim 17 wherein adjacent barriers are interconnected by articulated, load bearing joints, and wherein the engaging means of at least some of the transporting units are positioned to engage only every $N^{th}$ barrier, where N is an integer greater than 1.

25. The invention of claim 24 wherein N is less than 6.

26. The invention of claim 25 wherein each transporting unit has a length approximately equal to that of N barriers.

27. The invention of claim 24 wherein N equals 3.

28. The invention of claim 27 wherein each transporting unit has a length approximately equal to that of three barriers.

29. The invention of claim 17 further comprising means, included in the train and independent of the at least one tractor, for steering an intermediate section of the train positioned centrally of the ends of the train.

30. The invention of claim 17 further comprising means for coupling the lifting means together for common control; and means for centrally controlling all the lifting means from the tractor means.

31. The invention of claim 17 wherein at least some of the transporting units each comprise:

a U-shaped wheel supporting frame having a central portion pivotably connected to one end of the spine and a pair of downwardly directed side portions spaced to receive one of the barriers therebetween;

wherein the wheels are each rotatably mounted at a lower end of a respective one of the side portions.

32. The invention of claim 31 wherein at least some of the engaging means are mounted to respective ones of the central portions.

33. The invention of claim 32 wherein at least some of the lifting means are mounted to respective ones of the central portions.

34. The invention of claim 31 wherein the spine of one transporting unit is configured to fit between the side portions of the frame of another transporting unit to allow the transporting units to be nested for compact storage.

35. A method for transporting a length of highway barriers of the type having a lifting surface, said method comprising the following steps:

a) providing a transporter comprising a train of barrier transporting units, each comprising a longitudinal element, at least one pair of wheels coupled to the longitudinal element and positioned to straddle a length of barriers, at least one engaging device configured to engage one of the barriers at the respective lifting surface, and at least one lifting device coupled to the longitudinal element and to the engaging device to lift the engaging device and engaged barriers; a plurality of articulating couplings, each mounted to a respective end of a respective longitudinal element and interconnecting axially adjacent transporting units; a set of at least one automotive tractor, each positioned at and coupled to a respective end of the train in line with the train to move the train; and means for powering the lifting devices and the engaging devices;

b) driving the set of at least one tractor to move the train over a length of highway barriers in straddling relation therewith;

c) engaging the engaging devices with at least selected ones of the highway barriers;

d) operating the lifting devices to lift the engaging devices and the engaged barriers;

e) driving the set of at least one tractor to transport the train and the engaged highway barriers to a new location;

f) operating the lifting devices to lower the engaging devices and the engaged barriers;

g) releasing the engaging devices from the barriers; and h) driving the set of at least one tractor to move the train, thereby leaving the highway barriers at the new location.

36. The method of claim 35 wherein the set of at least one tractor includes first and second tractors, each positioned at a respective end of the train.

37. The method of claim 35 wherein each of the at least one tractor is configured to straddle the barriers.

38. The method of claim 35 wherein barriers are initially positioned on a roadway having a breakdown lane, and wherein the train, the set of at least one tractor and barriers are sized such that they may be maintained entirely in the breakdown lane during a major portion of step (e).

39. The method of claim 35 wherein each of the barriers defines a T-shaped upper portion, wherein step (c) engages the engaging devices with the T-shaped upper portions, and wherein step (d) comprises the step of suspending the barriers by the T-shaped upper portions under the transporting units.

* * * * *